United States Patent [19]

Koster et al.

[11] 4,152,799

[45] May 8, 1979

[54] SLIDE SWING BEARING

[75] Inventors: Waldemar Koster, Forsbach; Reinhold Huber, Rorbas, both of Switzerland

[73] Assignee: Kober AG, Switzerland

[21] Appl. No.: 918,088

[22] Filed: Jun. 22, 1978

[30] Foreign Application Priority Data

Jun. 24, 1977 [DE] Fed. Rep. of Germany ..... 2728549

[51] Int. Cl.[2] ..... E01D 19/06

[52] U.S. Cl. ..... 14/16.1; 308/2 R; 52/167; 248/346

[58] Field of Search ..... 14/16.1; 248/22; 308/2 R, 238; 52/573, 167

[56] References Cited

U.S. PATENT DOCUMENTS

| | | | |
|---|---|---|---|
| 2,256,984 | 9/1941 | Lemen | 248/22 X |
| 2,408,856 | 10/1946 | Hussman | 248/22 |
| 2,447,712 | 8/1948 | Nathan | 248/22 |
| 2,680,259 | 6/1954 | Milk | 14/16.1 |
| 3,105,252 | 10/1963 | Milk | 52/167 |
| 3,301,609 | 1/1967 | Palfreyman | 14/16.1 X |
| 3,350,821 | 11/1967 | Jones | 52/167 |
| 3,436,129 | 4/1969 | James | 14/16.1 |

*Primary Examiner*—Nile C. Byers, Jr.

[57] ABSTRACT

A sliding swing bearing having upper and lower supporting members, one of which is movable relatively to the other and a slide member interposed therebetween in sliding contact with at least the movable supporting member. The slide member is formed of at least one series of uniformly shaped elements having cooperable peripheral contact edges and arranged in an endless interengaging chain, forming a central pocket. A lubricant is located in the pocket.

20 Claims, 16 Drawing Figures

Fig.12
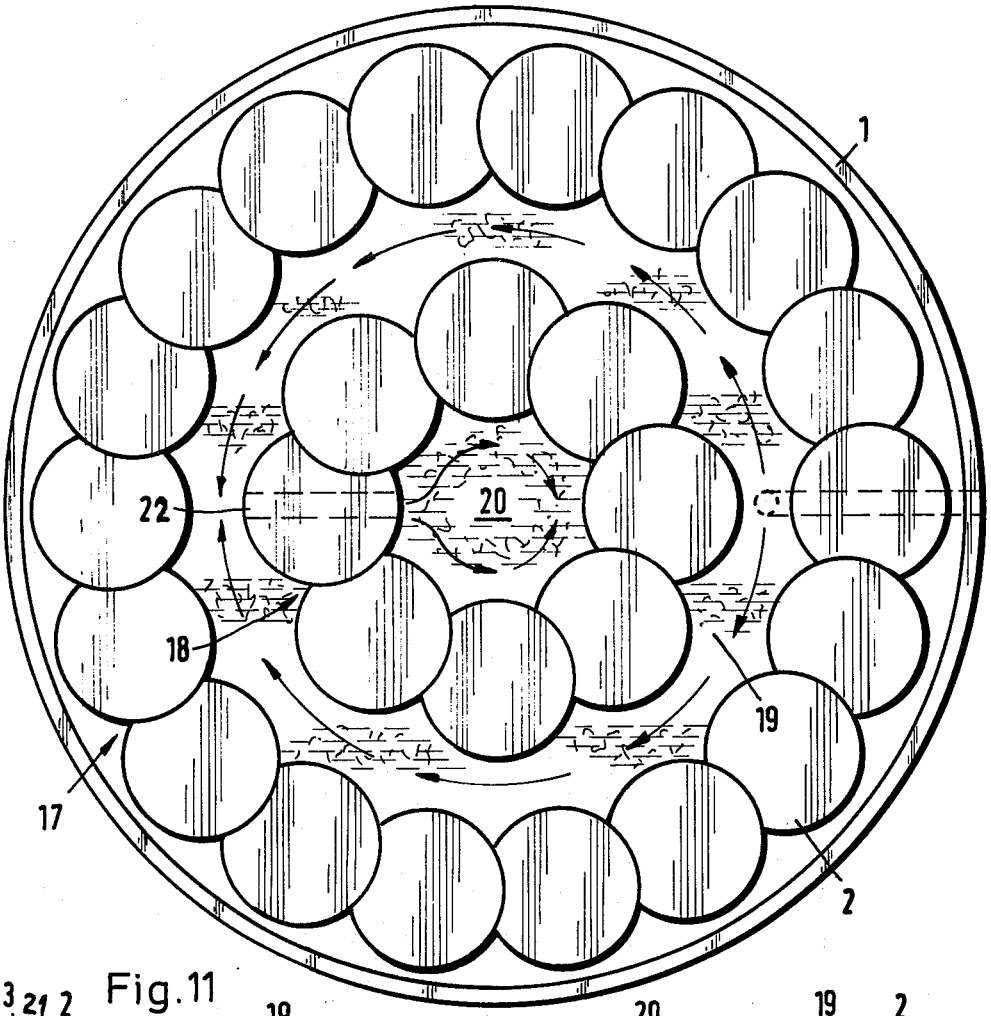
Fig.11
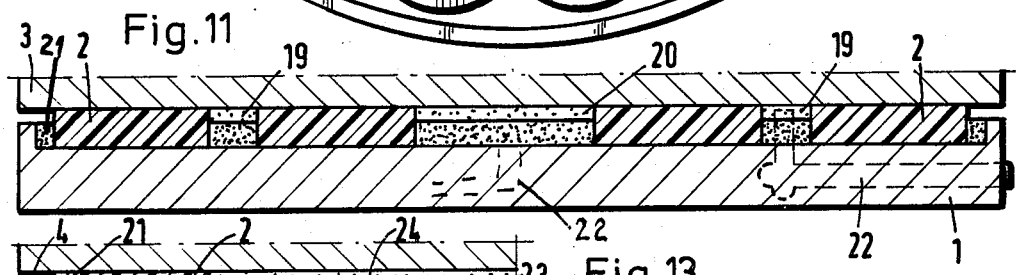
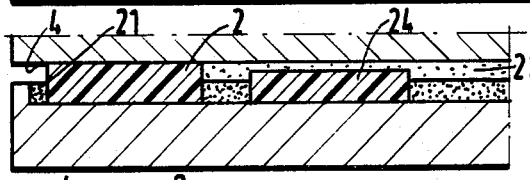
Fig.13
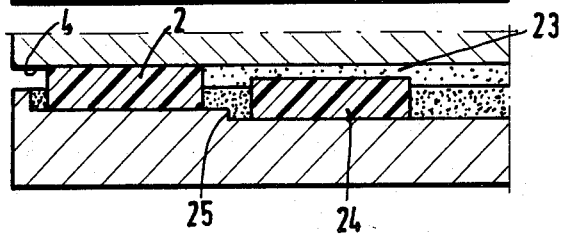
Fig.14

SLIDE SWING BEARING

BACKGROUND OF THE INVENTION

The present invention relates to a slide swing bearing for bridges or similar structures and in particular to the form and arrangement of the slide member therefor.

Slide swing bearings to which the present invention is directed, generally comprise an upper and lower support member, one of which is movable, i.e., slideable with respect to the other. Interposed between these two support members is a slide element generally formed of polytetrafluoroethylene (PTFE) or similar plastic material is employed. In German Pat. No. 1,230,826, a large area PTFE plate or plates, are employed as the slide members. Such arrangement is disadvantageous in several respects. The slide members must be carefully encased and mounted to insure that the PTFE, which is known to be a flowable material, will withstand the support pressure. Such mounts are usually made of steel, however, the adaption of a steel to the exact diameter of PTFE plate proves to be very difficult because of the approximately ten fold difference in coefficient expansion of PTFE relative to steel. When the PTFE plates are very large it is practically impossible to carry such adaption out. In addition, there does not exist at this moment, particularly for the production of large PTFE plates, a production method which insures that the quality of the plate material remains constant over the entire surface of the plate. Still further, in order to provide for permanent lubrication, lubricating pockets are provided in the PTFE plates. Since such pockets are eroded and leveled due to the creep of the PTFE plate, the lubricant supply is used up or dissipated after a relatively short period of time.

In order to improve the permanent lubricating effect in the known PTFE plates, it is proposed from German Pat. No. 2,244,202, and German Offenlegungsschrift No. 2,252,289, to replace the lubricating pockets with lubricating channels which are open toward the sliding plane and allow post lubrication of the plates from the exterior necessitating an expensive treatment of the PTFE plate itself.

Other known proposals, in particular, the General Road Construction Circular 10/1965, Subject 5, Bridge Construction, published VkBl official part, Issue 5-66, page 130; Uetz, Hakenjos, Breckel, "Fundamental Relative to the Development and Testing of Bridge Supports Made of polytetrafluoroethylene", material test 10/1968, 1, pages 23, 24, disclose an increase in the lubricant supply by forming the sliding member of a single ring or several concentric rings whose interior is filled with lubricant. These rings act as radial seals for the lubricant, however, their production and the arrangement of such rings in the bearing are very expensive. It is to be noted that such bearings employing ring type slide members have, so far, not materialized in practice.

Finally, it is known from German Auslegeschrift No. 1,263805 and German GNS 7,2740,733, to divide a PTFE slide plate into single slide elements which are distributed over the contact surface with the supporting member and are secured in the base plate of the supporting member spaced from one another. The fastening of such slide elements, which take the form of circular discs is effected by mounting the same in appropriately shaped support plates, or by casting the slide elements into a plastic material which is adhered to the supporting member. The use of such slide elements requires an expensive and individualized treatment of the supporting member, and in addition, makes the permanent lubrication of the slide elements practically impossible, since the lubricant can escape from the spaces formed between the slide elements.

It is the object of the present invention to provide a sliding swing bearing having PTFE slide surface members which do not present the production application difficulties arising from the use of large area plates or rings made of PTFE and which is functionally equal to the known PTFE ring supports with respect to its permanent lubrication effect.

SUMMARY OF THE INVENTION

According to the present invention, a slide swing bearing having upper and lower supporting members none of which is movable relatively into the other is provided with a slide member interposed there between which comprises at least one series of uniformly shaped slide elements, each of which is formed having cooperable contact edge portions so that they can be arranged in an endless inter-engaging chain forming a central pocket for the lubricant, the lubricant being placed within the pocket. By forming the slide member of a plurality of slide elements, of uniform shape, which form an endless inter-engaging chain, the production costs and effort, is considerably reduced. At the same time the endless chain forms an effective seal against the loss of the lubricant and the pocket may be filled with either a fluid or a pasty lubricant.

The sliding member, by being divided into individual elements which engage in one another, act to provide a compact sliding surface. The individual slide elements provide a continuous annular supporting slide surface for contact with the supporting member while the chain provides a pocket, enclosing the lubricant so that the lubricant form a lubricating pad in the interior of the chain of a very large volume. The relatively large lubricant volume permits a long term lubricating effect to be obtained.

The production of individual sliding elements of a uniform quality of material and with a high accuracy of shape does not present any production problems. The inter-engaging peripheral contact edges can be in the form of arcuate sections, toothings, such as gear formations, or cooperating keying hooklike members. As a result, a reliable seal against the radial emergence of the lubricant is provided. The expansion of the material under temperature differences are compensated for by the plastic deformation of contact edges when the element is subjected to loading conditions.

A further advantage of the present invention lies in the formation of the inter-engaging peripheral edge surfaces of arcuate, gear, or tooth form, so that they may be adjustable in different positions of rotation. This permits the formation of an annular chain of desired diameter. For large size bearings, wherein larger sliding surface members are necessary, it is advantageous if more than one chain is employed. Each chain of a series of slide elements can be formed concentrically with the other and the spaces between the concentric chains can also be filled with the lubricant.

A further advantage of the present invention lies in the fact that post lubrication of the bearing or the exchange of lubricant can be effected in a simple manner. To this end, lubricant channels or ducts for the delivery or drainage of the lubricant can be formed in either one of the supporting members extending therethrough to communicate with the interior of the chain or the interspaces between concentric chains.

The individual slide elements, comprising the chain may be fixed on the associated support member in a particularly economic manner, in that they can first be mounted on a mount of hard metal or hard plastic material conforming to their shape and size. The mount should have an upwardly extending rim to reinforce the peripheral edges of the slide element. The material on the slide element being drawn or molded over this rim, so as to cover the peripheral edge. The mount may be manufactured as an extruded metal part or as a plastic material by injection molding. The PTFE may be either inserted into the mount as a finished part, by force fitting, or may be directly molded or sintered within the mount.

When the individual slide elements are arranged in interlocking position, attention must be paid to the sealing property of the interlocking engagement. In the event slide elements without reinforcing mounts are employed, there occurs due to the creep properties of the PTFE, a plastic deformation of the slide element, and thus, the sealing cooperation thereof in the chain combination can be effected when the bearing is placed under load conditions. When the mount is used, the sealing effect in the contact areas should be insured by having the PTFE extend beyond the lateral edge of the re-enforcing mount so as to cover its peripheral edge.

A particularly advantageous design can also be obtained by embedding the slide elements in a resinous or plastic layer formed in the associated supporting body to which it should be attached. This resinous or plastic bed and be molded in situ after the slide element chain is placed in position on the associated supporting member, or the bed can be preformed and placed on the supporting member and provided with depressions or recesses to receive and hold the individual slide elements in force fit.

Full details for the present invention are set forth in the following description, and are show in the accompanying drawings.

BRIEF DESCRIPTION OF THE DRAWINGS

In the attached drawings:

FIG. 11 is a sectional view similar to that of FIG. 1, showing a bearing with two concentric chains of slide elements;

FIG. 12 is top plan view of the bearing according to FIG. 11 with the top supporting member removed;

FIGS. 13 & 14 show partial cross sections through a bearing similar to that of FIG. 11, with the internal concentric chain formed of sliding element recessed from and spaced from the upper supporting member;

DESCRIPTION OF THE PREFERRED EMBODIMENTS OF THE PRESENT INVENTION

Figure 1:
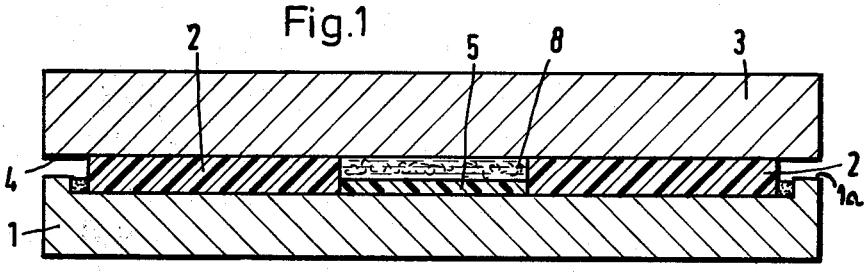
FIG. 1 is a sectional view through a slide swing bearing showing a construction in accordance with the present invention.
Figure 3:
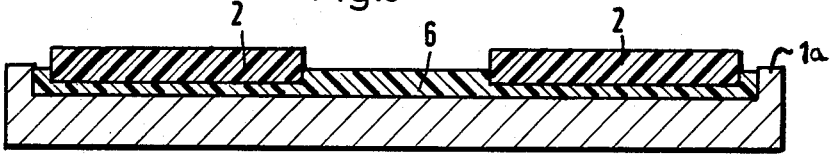
FIG. 3 is a sectional view similar to that of FIG. 1, showing bearing having the slide elements supported on a retaining bed in the lower support member.

The bearing illustrated in FIG. 1 comprises a lower or foundation support member 1 having a perimetal lip 1*a* within which are laterally encased a plurality of slide elements 2 having conforming contact edges reciprocally engaging with each other to form an endless ring or chain. Resting upon the upper surface of the slide elements 2 is an upper or structural support member 3 having a counter sliding surface 4. The support members 1 and 3 are preferrably made of steel plate; their counter sliding surfaces 4 being preferrably formed by a coating of hard chrome, high quality steel plate or a plastic material having a low coefficient of friction. The slide elements 2 are generally of a circular disc shape and are formed of PTFE which is the optimum bridge support material at the present time because of its low coeffecient of friction. The circular discs are provided with an arcuate sector 2*a* which conforms to the circumferential arc of the remainder of the disc so as to effect the conforming contact surface edges. Due to the known fact that PTFE creeps under load, these circular discs have to be laterally supported or retained. This can be effected by providing a resinous cast layer 5 poured into the interspaces between the discs 2 and the perimeter 1*a* of the lower support member as shown in FIG. 1. After the resinous layer is poured it hardens in situ about the discs holding the discs in their fixed position. The resinous layer should have a thickness of substantial depth, so as to hold the discs 2 securely. Another possibility for encasing the slide elements is shown in FIG. 3 where the slide elements hereto are pressed or themselves poured to form in situ into a preformed plate 6 of plastic material having recesses to form the slide elements 2. The plastic material forming the plate 6 may be epoxy, polyester or phenolic synthetic resins or the like, and is fixed for example by means of gluing to the surface of the lower support member 1.

The slide elements 2 are preferrably approximately 5 to 6 mm. thick. In any event, these elements are thicker than the vertical extent of the perimetal lip 1*a* so that they project 2 to 3 mm. above the lip. Their diameter is preferably approximately 40 to 80 mm. Up to this dimension, the manufacture of PTFE plates of uniform shape and quality and their encasement in the bridge supporting member does not present any problem.

Figure 2:
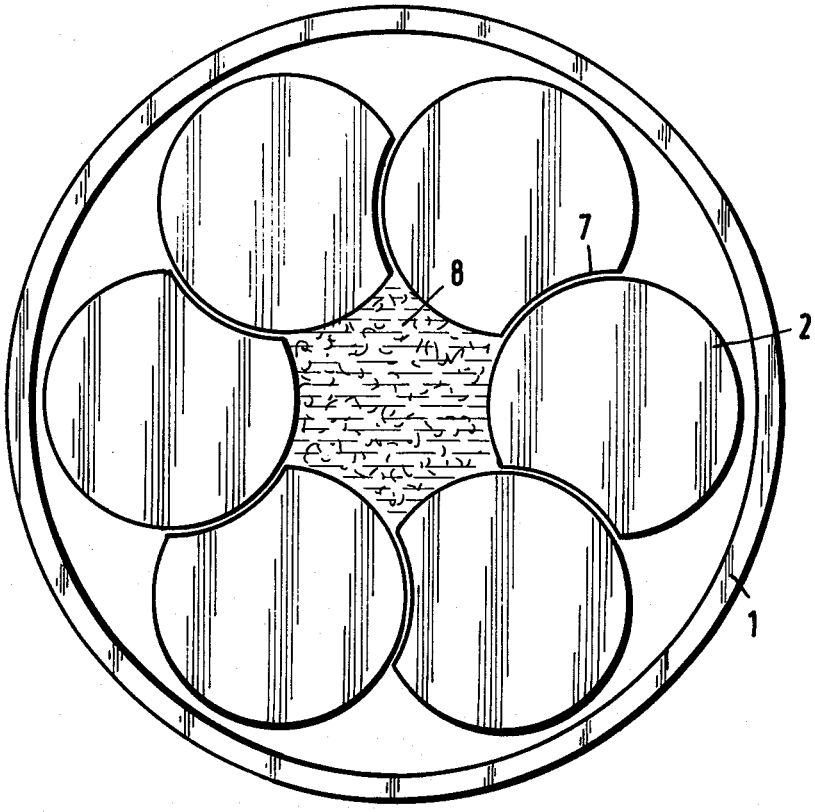
FIG. 2 is a top plan view of the bearing with the upper support member removed showing the annular chain of circular slide elements, according to FIG. 1.

The reciprocal interengagement of the slide elements 2, shown in FIG. 2, is formed by the circular segment 7 which conforms in its contour, as previously described, to the circumferential arc of the sliding element. The disc-like contour of the adjacent slide element 2 thus engages within the circle segment 7. Since support loading at the bearing causes the PTFE material to creep, the individual slide elements are caused to come into contact with each other along the contact edges defined by the circular segment 7. As a result, a chain or ring of endless form is provided, which effectively seals the center of interior thereof. This interior is filled with a lubricant forming a lubricating pad 8. This lubricating pad 8 is also subjected to the support loading and is maintained in the pocket under pressure. The support compression must be related to the entire surface covered by the sliding element 2 and the lubricating pad 8 so that a uniform compression extends across the entire counter slide surface 4.

Figure 4:
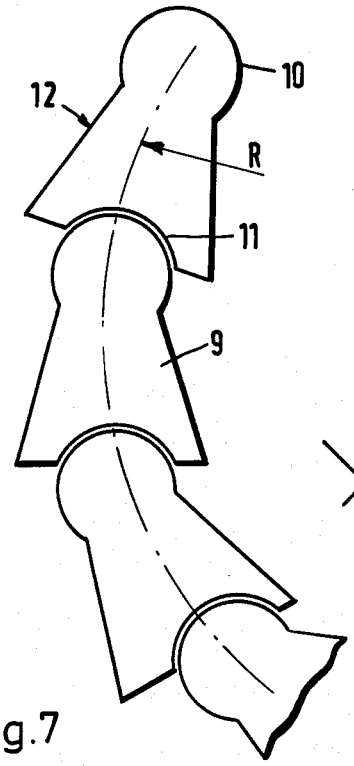
FIG. 4 illustrates in plan view a plurality of a slide elements having interlocking key means arranged in a partial chain.

In FIG. 4 there is illustrated a slide element 9 whose plan area or shape differs considerably from the circular disc shape shown in FIGS. 1 through 3. In this form each of the slide elements 9 has a shape similar to that of a keystone or keyhole having a circular segment 10 at its head and a corresponding circular recess 11 at its tail, the inner contour or arc of which conforms to that of the circular head 10. It will thus be observed that these elements can be arranged in a series to provide endless chain. The circular design of the interengaging head 10 and tail 11 insures a reciprocal alignment of the sliding elements in any position of rotation, within the common plane. By this means, it is obvious that the employment of any selected number of elements will produce any desired radius to form a continues chain 12 in the nature of a ring, within the supporting members. Numerous other constructional forms and shapes will be obvious.

Figure 5:
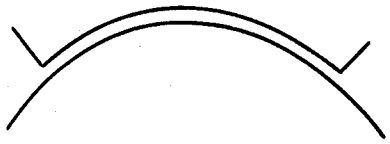
FIGS. 5 through 8 show different form of interengaging peripheral edge surfaces which may be substituted for those shown in the FIGS. 2 & 4.
Figure 6:
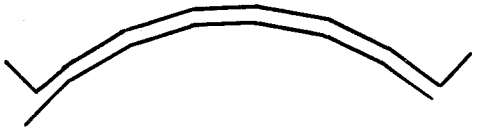
Figure 7:
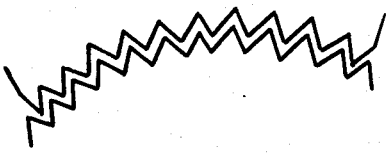
Figure 8:
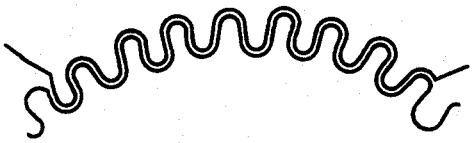

In FIG. 5 the slide elements are illustrated having interengaging edge portions of oval sectional shape, rather than circular sectional shape. Apart from the smooth contours shown in FIGS. 1 through 5, the circular engagement contacting edges may take the form of a plurality of small line segments, for example in the shape of a polygon, as shown in FIG. 6. In addition, the interengaging contacting edges may take the form of toothings or gear formations. In FIG. 7 a toothing is shown having pointed apeces. In FIG. 8 a toothing or gearing is shown wherein the addendum is wider than the dedendum. The interengaging toothings need not extend over the entire circumference of the slide element but only as is shown in FIG. 4. those portions which can key or mate. The essential feature in these embodiments, as in the circular embodiment previously described lies in the provisions of edges which not only affect a sealed interengagement between the serially arranged slide elements, but also permits the adjacent elements to be adjustable and rotational, in the same planewith respect to each other so that an endless chain of selected numbers of slide elements can be formed in many desired radius R.

Figure 10:
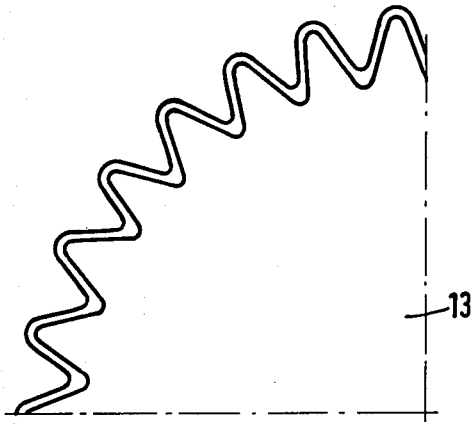
FIG. 10 is a top plan view of the mount used in the embodiment of FIG. 9, without the slide element inserted therein.
Figure 9:
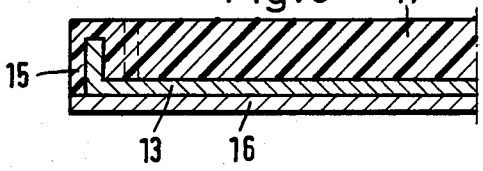
FIG. 9 illustrates a partial sectional view through a slide element provided with a reinforcing mount.

The PTFE slide element may be encased in a reinforcing mount, as shown in FIG. 9 and FIG. 10. The mount of 13 consists of metal or hard plastic materials, and of course, has a contour that is idential with that of the desired slide element. As shown in FIG. 10 the mount 13 comprises a dishlike member having a flat bottom, and an upstanding or vertical peripheral edge. As is seen in FIG. 9 the PTFE material forming the side element 14 is pulled laterally over the edge of the mount and covers the edge exteriorally. The thickness of the cover 15 is approximately one third of the wall thickness of the mount 15 and then the contact or engagement areas serves for the mutual seal of adjacent slide elements. The plastic deformation of the PTFE material causes a complete seal to be formed. The finished assembly consisting of the PTFE body 14 and the reinforcing mount 13 may be coated on its underside with an adhesive which is activated on placement in the support member on which it is mounted by application of pressure and the appropriate temperature during assembly. However, it is also possible to provide a thin elastomaric intermediate support layer 16 as shown in FIG. 9 which compensates for slight variances in tolerance or differences in support plate thickness, when applied to the supporting member. When circular or disc shape slide elements are employed it is advantageous if the arc forming the engagement area or contact edges is dimensioned so that their common chord has approximately the length of the radius of the circular disc.

A large area slide being is shown in FIGS. 11 and 12. This bearing has an upper support member 3, a lower support member 1, and two annular chains 17 and 18, each consisting of circular slide elements 2, of the type illustrated in FIGS. 1 through 3. The slide elements forming the chains 17 and 18 can be however formed of the elements shown FIGS. 4 through 10. The chains 17 and 18 are concentrically arranged and spaced from each other. The annual space 19 between the two chains and the central interior 20 within the inner chain, are filled with a lubrican such as a lubricant grease. The slide elements 2 are laterally encased within a resin bed 21 which may be performed or formed in situ. In order to enable post lubrication of the bearing a lubricating duct 22 is provided in the lower support member. The duct 22 has a fitting on its exterior end to which a supply or source of lubricant can be included. The duct 22 extends to and communicates with the annual space 19 between the concentric chains. For the exchange of lubricant, lower support member can be made with a second duct 22*a* extending from its exterior into communication with the interior pocket 20.

FIGS. 13 and 14 show vertical cross sections through a bearing cut along its center line, illustrated by the dot-dash line. The structure of FIGS. 13 and 14 is similar to that of FIGS. 11 and 12, except that some of the slide elements 24 forming the inner chain are recessed out of contact with the counter sliding surface 4 of the upper support member; as a result of which, the inner and outer lubricating pads 19 and 20 shown in FIG. 1 are joined together by bridging pads 23. In the embodiment of FIG. 13, the recessed elements 24 are made of a thickness less than that of the slide elements 2 which form the exterior chain 17. In the embodiment of FIG. 14 the lower supporting member 1 is provided with a stepped recess 25 which enables slide elements 24 of the same thickness as those of slide elements 2, to be recessed below the counter surface 4. In either case, the bridging lubricant pad 23 is effected between the slide surface 4 and the slide elements 24. These recessed slide elements 24 insure antifrictional properties for the bearing in the event the slide elements wear and the upper support member 3 is loaded closer to the lower support member 1. After the wear of the exterior elements chain, the bearing surface will contact the surface of the recessed elements 24.

Figure 15:
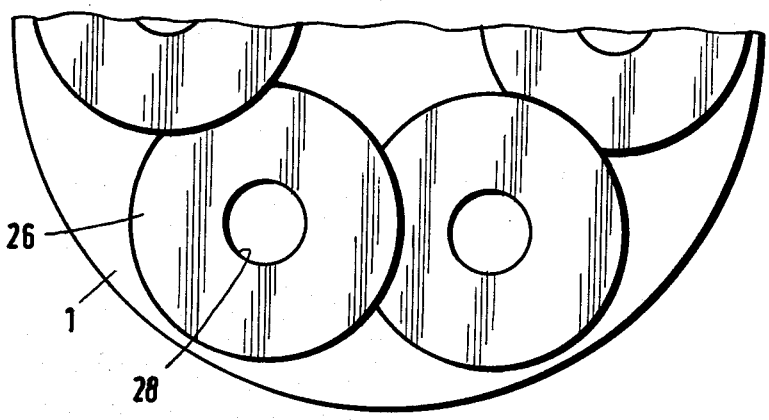
FIG. 15 is a partial top plan view of the lower supporting member carrying annular ring type slide elements.
Figure 16:
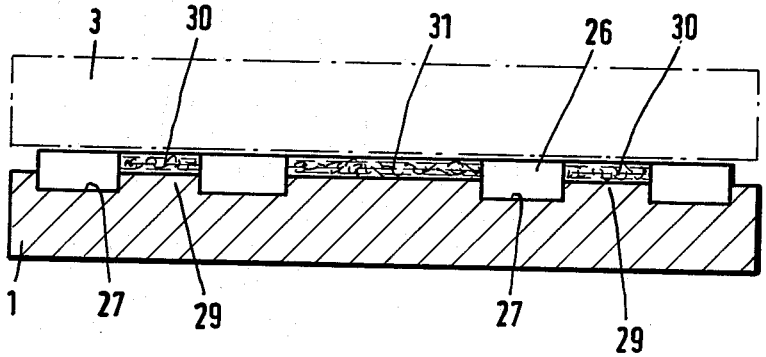
FIG. 16 is a sectional view through the bearing according to FIG. 15.

As illustrated in FIG. 15 an embodiment is shown wherein the slide elements are formed of annular or ring shaped members at 26 having an enlarged central bores 28. The interlocking or interengaging edges are similar in manner to those shown in FIGS. 1 to 3 or can be modified to conform to those shown in FIGS. 4 through 10. The lower support member 1 comprises as shown in FIG. 16 depressions or recesses 27 which correspond in shape exactly to the contour of the ring shaped annular elements 26, including a vertical pin 29, so that the slide elements 26 can be received in these depressions in a tightly fitting or forced manner. Compared with the aforedescribed disc shape design of the slide elements the annual ring shaped design of FIGS. 15 and 16 has the advantage that the pin 29 which enters the central bore 28 facilitates the milling of the depression 27 so that an exact formation and force fit is obtained. The height of the pin 29 can be recessed so as to provide a lubricant pocket 30. The central interior can also be provided with a lubricant pocket 31 as illustrated in FIG. 16.

Various embodiments, modifications, and changes have been suggested in the foregoing description. Accordingly, it is intended that the present disclosure be taken as illustratively only, and not limiting of its scope.

What is claimed is:

1. A sliding swing bearing comprising upper and lower supporting members, one of which is movable relatively to the other and a slide member interposed there between in sliding contact with the movable supporting member, said slide member comprising at least one series of slide elements formed with cooperable contact edges and arranged in an endless interengaging chain, forming a central pocket and having a lubricant located therein.

2. The bearing according to claim 1, wherein the contact edges of said slide element permit relative movement between said slide elements.

3. The bearing according to claims 1 or 2 wherein said contact edges are arcuate sectors.

4. The bearing according to the claims 1 or 2 were in the contact surfaces are toothed.

5. The bearing according to claim 1 wherein at least two series of slide elements are arranged in chains concentric with each other and lubricants provided there between and within the interior of said chains.

6. The bearing according to claim 5 wherein at least one of said slide elements within said inner chain has a surface recessed below the surface of the other slide elements and out of contact with the movable support member.

7. The bearing according to claim 1 wherein at least one of said support members is provided with a duct for the passage of lubricant between the interspaces between said slide elements.

8. The bearing according to claim 1 including means for securing said side elements to one of said support members.

9. The bearing according to claim 8 were in said means for securing such slide elements comprises a bed of plastic material in which said slide elements are embedded.

10. The bearing according to claims 8 or 9 wherein said plastic material forming said means for securing such slide elements is molded in situ about said elements.

11. The bearing according to claims 8 or 9 wherein said plastic material forming said means for securing such slide elements is preformed and provided with recesses for receiving said slide elements in conforming force fit.

12. The bearing according to claim 8 wherein said means for securing said slide elements comprises an adhesive interposed between said slide elements and said one support member.

13. The bearing according to claim 1 wherein each of said slide elements is respectively reinforced within a mount conforming in shape to said slide element.

14. The bearing according to claim 13 wherein each of said slide elements is formed to overlap the edge of its mount and covers the perimeter thereof.

15. The bearing according to claim 1 wherein one of said support bodies is formed with recesses, each conforming to the shape of said respective slide elements to receive the same.

16. The bearing according to claim 15 wherein said slide elements are rings and said body is formed with conforming annular depressions for respectively receiving the same.

17. A sliding support as claimed in claim 1, wherein each of the sliding elements are received and encased in a corresponding depression of the associated support body and project from the top thereof.

18. A sliding support as claimed in claim 17, wherein said sliding elements are as rings and are received in appropriately formed annular depressions of the associates support body.

19. The bearing according to claim 1 wherein the slide elements are formed of polytetrafluoroethylene.

20. The bearing as claimed in claim 18 wherein the central annular depression of each of the sliding plates contains a lubricant.

* * * * *